United States Patent [19]

Rio

[11] 4,062,329

[45] Dec. 13, 1977

[54] FAN DRIVE SYSTEM

[75] Inventor: Russell L. Rio, Dalton, Mass.

[73] Assignee: The United States of America as represented by the Secretary of the Army, Washington, D.C.

[21] Appl. No.: 709,839

[22] Filed: July 29, 1976

[51] Int. Cl.[2] ..... F01P 7/02

[52] U.S. Cl. ..... 123/41.12; 123/41.49; 236/35

[58] Field of Search ..... 123/41.11, 41.12, 41.02, 123/41.63, 41.65, 41.66, 41.49; 236/35

[56] References Cited

U.S. PATENT DOCUMENTS

| | | | |
|---|---|---|---|
| 2,594,460 | 4/1952 | Lauck | 123/41.12 |
| 3,182,912 | 5/1965 | Weisenbach | 236/35 |
| 3,359,831 | 12/1967 | Scheiter | 123/41.12 |
| 3,483,852 | 12/1969 | Newman et al. | 123/41.12 |
| 3,710,765 | 1/1973 | Dorsch | 123/41.12 |
| 3,942,486 | 3/1976 | Kirchner | 123/41.12 |

*Primary Examiner*—Charles J. Myhre

*Assistant Examiner*—Andrew M. Dolinar

*Attorney, Agent, or Firm*—Peter A. Taucher; John E. McRae; Nathan Edelberg

[57] ABSTRACT

A variable speed fan drive mechanism for an engine coolant system controlled by temperature and fan speed signals. The mechanism includes a hydrostatic pump-motor unit (hydrostatic transmission) powered by the engine, for transmitting power to the fan. Mechanical signals related to coolant temperature and fan speed are supplied to a comparator mechanism that delivers a mechanical output control signal. The output control signal is magnified and applied as a control force to vary the displacement of the pump in the hydrostatic unit. The comparator mechanism has the effect of negating engine speed as a control force. Thus, high engine speeds (that would tend to produce unduly large hydraulic flows through the pump-motor circuit) are reflected in high fan speed signals fed into the comparator mechanism, which produces a "corrected" output signal that appropriately reduces pump dislacement to thus reduce the fan speed to low energy consumption levels.

4 Claims, 2 Drawing Figures

Fig-1
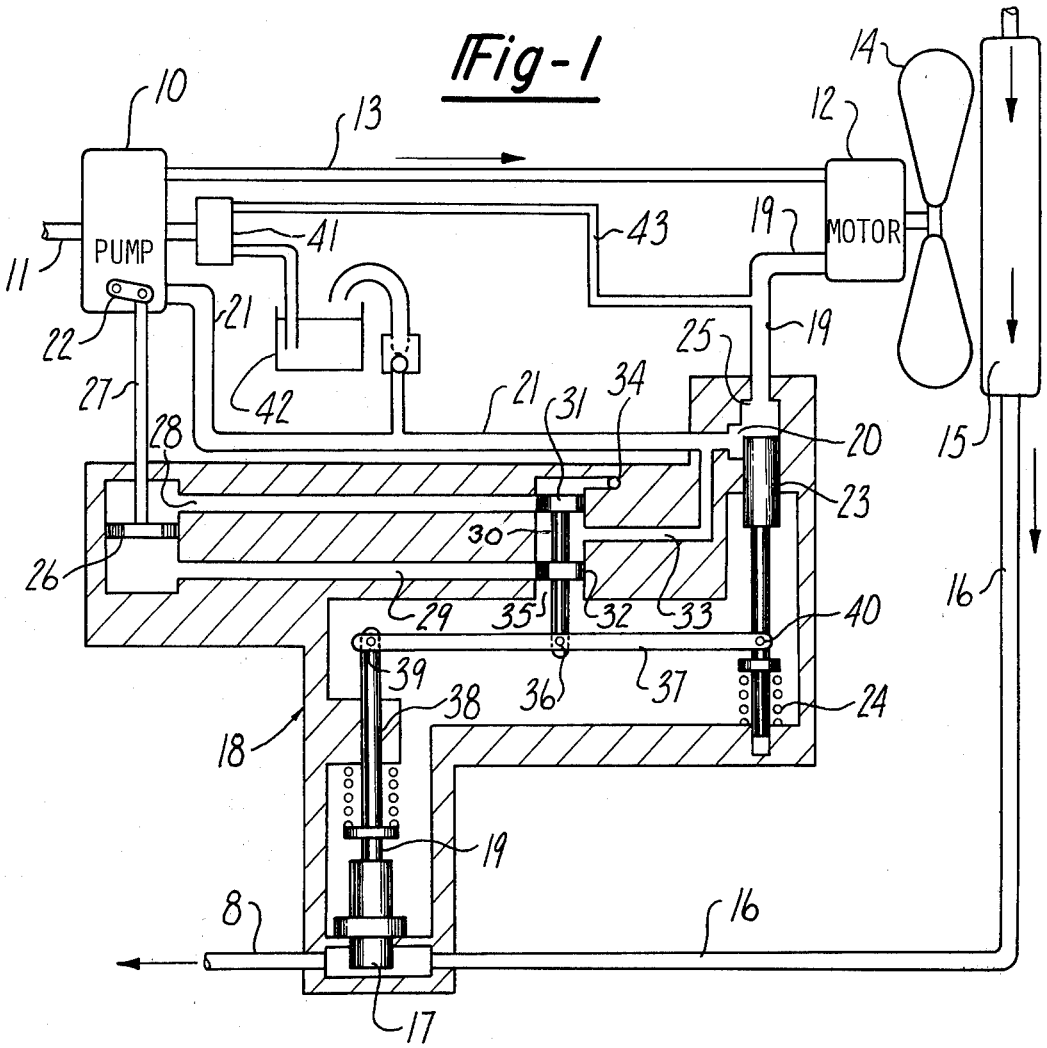
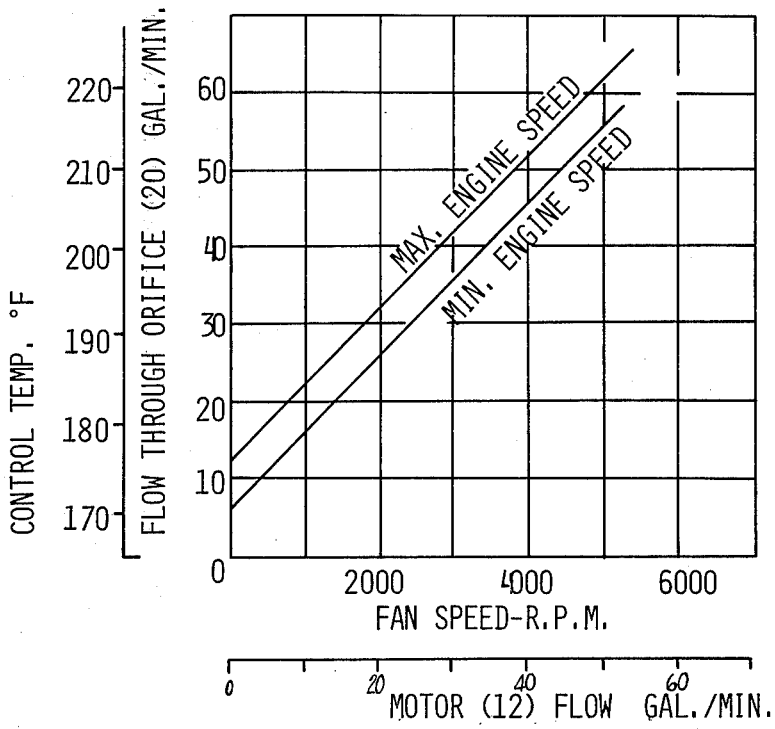
Fig-2

FAN DRIVE SYSTEM

The invention described herein may be manufactured, used, and licensed by or for the Government for governmental purposes without payment to me of any royality thereon.

BACKGROUND AND SUMMARY OF THE INVENTION

The power required for driving the cooling fans on high performance vehicles reduces the power available for propulsion and seriously limits vehicle performance. For maximum over-all efficiency the fan must be driven at the exact speed required to cool the engine and transmission fluids under each operating condition. Therefore it is desirable that the fan speed be controlled relative to the cooling demand and independent of engine and vehicle speed.

Various fan drive systems are known which provide variable ratio between the fan and the engine and thereby prevent the excessive waste of power at high speeds, however they have deficiencies which restrict vehicle performance under certain operating conditions, particularly during engine acceleration. In such systems, when the engine is accelerated to higher speed, the fan must be accelerated by the engine, and the fan inertia, reflected through the drive ratio, burdens the engine and reduces its acceleration rate.

The invention described in this disclosure presents an improved fan drive system that will provide fan speed as required by the cooling load and permit engine acceleration without the burden of fan inertia. The system consists of a power-take-off driven variable displacement hydraulic pump, which drives a hydraulic motor, which drives the fan. Motor and fan speed are controlled by varying the pump displacement. The control measures temperature of the fluid being cooled and governs fan speed relative to the fluid temperature. Fan speed is measured by the return flow from the motor. When the engine speed increases or decreases the control automatically decreases or increases pump stroke to hold the oil flow, motor speed and fan speed constant. Therefore, the engine can be accelerated without changing the fan speed or horsepower load. To improve engine acceleration, the control can be biased to reduce fan speed slightly as the engine speed increases and thereby reduce the load on the engine. This is accomplished by adding the make-up flow to the return flow from the fan motor before the speed measuring device; thus the control reduces drive pump stroke and motor speed to offset the increase in make-up flow as engine speed increases.

THE DRAWINGS

FIG. 1 schematically illustrates a fan speed control system embodying the invention.

FIG. 2 is a performance graph for the FIG. 1 system.

The fan drive system is shown in FIG. 1. A variable displacement pump 10 is driven from the engine power take-off through shaft 11. Oil is pumped to a fixed displacement hydraulic motor 12 through oil line 13, causing the motor to rotate and drive the cooling fan 14, forcing air through the radiator 15 to cool the fluid flowing through the radiator and line 16. The cooled fluid flows through line 16 across the thermostat 17 and out line 8 to the component being cooled, e.g. the engine. The thermostat 17 internally expands or contracts in response to changes in the fluid temperature, to thereby apply a temperature input signal to control mechanism 18 via piston 19. It is understood that thermostat 17 can be located remote from the control 18, and the temperature signal may be transmitted by mechanical, hydraulic, or electrical means to the control.

Returning to the hydraulic motor 12, the driving oil is exhausted to line 19 and flows to the control 18 where it passes through the variable orifice 20 to line 21 and back to the inlet of the pump 10. The pump displacement is variable and controlled by link 22 which, for this illustration, increases displacement when rotated clockwise, and decreases displacement when rotated counterclockwise. It can be seen that for any given pump speed, fan speed can be increased or decreased by increasing or decreasing pump displacement.

The orifice 20 area is determined by the position of piston 23. Spring 24 acts to force the piston in the direction to reduce the orifice area, and pressure in cavity 25 acts against the piston to increase the orifice area. Flow from line 19 causes a pressure rise in cavity 25 which causes the piston 23 to move against spring 24 and increase orifice area. When the area of orifice 20 is such that the restriction to flow causes a pressure force in cavity 25 equal to the spring force, the system is in equilibrium. Since the flow in line 19 is proportional to motor speed, and the position of piston 23 is related to flow, piston position provides a motor speed input signal to control mechanism 18.

The control 18 regulates pump displacement to maintain correct fan speed for the cooling load, as determined by the temperature of the cooled fluid flowing past thermostat 17. The pump displacement control link 22 is actuated by piston 26 through rod 27. Piston 26 is positioned by flow and pressure in lines 28 and 29, as controlled by a pilot valve 30. Valve lands 31 and 32 are positioned over the ports to lines 28 and 29 in the null position; when the valve is moved up or down to supply oil from line 33 to one side of piston 26 the opposite side is opened to drain cavity 34 or 35.

Valve 30 is connected by pin 36 to link or lever 37, which is also connected to the temperature reference plunger 38 by pin 39 and the speed reference piston 23 by pin 40. The position of valve 30 is determined by the position of pins 39 and 40, i.e. the relationship of orifice flow to temperature of the cooled fluid. It can be seen that for any temperature, in the temperature control range predetermined by the expansion rate of thermostat 17, there is a flow through orifice 20 which will position piston 23 and pin 40 so that valve 30 is in the null position. At the minimum control temperature the valve will be in the null position when flow through orifice 20 is minimum; at the maximum control temperature the valve will be nulled when the flow through orifice is at the maximum controlled rate. At any temperature within the control range the valve will be in the null position when flow is proportional to temperature.

By controlling flow through orifice 20 in proportion to coolant temperature in the temperature control range, the device acts to provide fan speed as required by the cooling load. For example, if the engine or transmission fluid flowing through radiator 15, line 16 and past the thermostat 17 is below the desired operating temperature which is also the minimum control temperature, the thermostat will be in its contracted position; and piston 19, plunger 38 and pin 39 will be in their maximum downward position. Valve 30, connected by pin 36 to link 37, and pin 39 will be held in a position downward from the null position, and supply oil from line 33 will be ported to line 29; line 28 will be vented to drain. This will force piston 26 and rod 27 to their uppermost position, and rotate displacement control link 22 counterclockwise to its zero position. With zero displacement pump flow is zero, and the motor 12 and fan 14 will not rotate. Therefore no cooling is applied when the fluid in the cooling circuit is below the desired operating temperature. When the temperature of the fluid in the cooling circuit rises above the minimum control temperature, thermostat 17 will expand causing piston 19, plunger 38 and valve 30 to move upward. This will expose line 28 to supply oil and line 29 to drain, thereby causing piston 26 to move downward. The downward motion of piston 26 through rod 27 and link 22 will increase the pump displacement and cause oil to flow through line 13 to the motor, causing it and the fan to rotate. Fan and motor speed will increase until the flow in line 19 and through orifice 20 positions piston 23 so that valve 30 is nulled. If the fan speed is adequate to cool the fluid passing through radiator 15, the temperature will stabilize. If the fan speed is not adequate to cool the fluid flowing through the radiator, the temperature of the fluid will rise, causing the thermostat to expand further and the fan to run faster. Likewise if the fan speed is greater than that required to cool the fluid in the radiator, the temperature will fall, causing thermostat 17 to contract and the fan to run slower.

It is apparent that fan speed will be controlled relative to cooling load regardless of engine speed. In addition to improving vehicle performance by increasing over-all efficiency, this feature improves engine acceleration and deceleration because engine speed can be increased or decreased without a corresponding change in fan speed. To further improve acceleration and deceleration, the control has a means to reduce fan speed and load momentarily as engine speed is increased, or to increase fan speed momentarily as engine speed is decreased. To illustrate this, refer again to FIG. 1.

A fixed displacement make-up pump 41 draws oil from the sump 42 and pumps it through line 43 to line 19. The primary function of the make-up pump is to replenish oil that leaks from the variable displacement pump 10 to sump. Since the make-up pump is fixed displacement and is driven at engine power take-off speed, its flow is proportional to engine speed. Pump 41 is in a hydraulic circuit that bypasses motor 12; therefore the pump 41 circuit is a low energy consumption circuit. By plumbing the make-up oil to the motor return line 19 before the speed reference piston 23, the make-up pump provides a secondary function of supplying an engine speed signal to control mechanism 18. As previously described, piston 23 is positioned by the flow through orifice 20; since the flow through orifice 20 is the combined flow from make-up pump 41 and fan-motor 12, the position of piston 23 is determined by the combined flow which is related to the fan-motor and engine speed. It should be noted that the make-up pump is sized to replenish leakage from the variable displacement pump 10, and that typically, leakage is only a small percentage of pump flow. Therefore the make-up flow is only a small percentage of the variable displacement pump output flow, which in this system is the same as motor 12 flow. Furthermore, it can be seen that if orifice 20, piston 23, spring 24 and thermostat 17 are sized so that valve 30 is nulled when the temperature of the fluid past thermostat 17 is at the minimum controlled temperature, and the flow through orifice 20 is equal to the make-up flow at engine idle and maximum engine speed affects the speed signal to the control. In other words, engine speed has only a small effect on the control in comparison to the motor 12 speed.

To aid in understanding the effect of an engine speed change on the system, certain characteristics are assigned to the components of the drive; the relationship of speeds, flows, and temperature is shown in FIG. 2. It is understood that the values shown are representative of a workable system and are used here to illustrate control characteristics, but these values may be varied to suit specific design requirements of the fan driven system. In FIG. 2, the fan speeds and corresponding fan-motor flow is shown along the abscissa. Along the ordinate, the controlled temperatures of the coolant are shown, with the corresponding flow through orifice 20 that will null valve 30. It can be seen that make-up flow is 6 gpm when the engine is at minimum speed, and increases to 12 gpm when the engine is at maximum speed. Also, the fan-motor flow is 66 gpm at 6600 rpm, or 1 gpm per hundred rpm.

To illustrate the operation of the system during an engine speed change, assume a condition where the engine is operating at minimum speed, and the cooling load is such that the coolant temperature has stabilized at 190° F. The fan-motor speed at this condition would be about 2200 rpm, and the motor flow 22 gpm. The combined motor and make-up pump flow passing through orifice 20 would be about 28 gpm. If the operator were to accelerate the engine to maximum speed, oil flow from both the variable-displacement pump 10 and make-up pump 41 would begin to increase with the increase in engine speed. This increase in flow would cause piston 23 to move downward and position valve 30 so that oil would flow to line 29 and cause piston 26 and rod 27 to move upward, turning link 22 counterclockwise in the direction to reduce the displacement of pump 10. The reduction in displacement will continue until the flow through orifice 20 is reduced to 28 gpm and the valve 30 is again nulled. The control will act to keep the flow through orifice 20 constant by decreasing the displacement and flow from pump 10. It can be seen that as engine speed increases the displacement of the pump will be decreased to compensate for the increase in make-up flow as well as the increase in pump speed. Stated differently, as engine speed increases, the flow to the motor 12, and the fan speed, is reduced to compensate for the increase in make-up flow through line 43. Referring again to FIG. 2, when engine speed reaches maximum, the flow through orifice 20 will still be 28 gpm to satisfy the temperature, but the flow is now made up of 12 gpm from the make-up pump, and 16 gpm from the motor; fan speed is reduced from 2200 to 1600 rpm.

The change in fan speed with a change in engine speed is only momentary for the control still acts to adjust fan speed as required for cooling, but at a slower rate. For example, when the engine speed is increased the control responds immediately to the change in flow and decreases fan speed as engine speed increases. But then as the fan speed is reduced less heat will be removed from the fluid flowing through the radiator, and the temperature of the fluid flowing past the thermostat will gradually rise. The rise in temperature will cause the thermostat to expand causing the control to increase pump displacement (as previously described) and fan speed until the temperature is stabilized.

The momentary reduction in fan speed as engine speed increases aids acceleration because the fan load reflected to the engine decreases with decreasing fan speed. Like-wise, when engine speed is decreased, fan speed will be momentarily increased and the reflected load increased to aid deceleration.

For the sake of clarity, the fan drive system has been shown and described with a single fan, radiator and thermostat, however, the same drive system and control could be used to drive several fans to cool more than one fluid. Fan drive motors may be connected in series or parallel, and thermostat signals from each circuit may be combined in series or parallel or proportioned to obtain the desired balance of cooling. The same benefits to engine and over-all system performance could be obtained.

In the attached claims the following terms are used to describe certain components. Pump 10 and motor 12 are collectively termed a "hydrostatic transmission". Arm structure 37 is termed a "comparator means" for comparing two signals developed, respectively, by thermostatic means 17 and fan speed responsive means 23. The comparator means is stated to have an "output signal" which, in the illustrated structure, is the motion produced at connection point 36. Valve 30 and piston 26 cooperatively define a "force-multiplication means". This force-multiplying action is obtained because the dead-ended piston chamber produces high pump pressure at one piston face and low drain pressure at the other piston face, and vice versa; a relatively small control force applied at point 36 produces a relatively large operating force in rod 27.

The fan drive system described in this disclosure possesses several advantages over other available systems as follows:

1. Cooling and fan speed are supplied only as required, thereby saving power and improving overall system efficiency.
2. Fan speed is automatically reduced when engine speed is increased, to reduce fan load and increase the acceleration rate. Conversely when engine speed is reduced fan speed is automatically increased to provide braking and aid engine deceleration.
3. Fan motor and fan may be located remote from the engine power take off to facilitate installation of the system in the vehicle.

I do not desire that the claims be limited to the exact details of construction shown in the drawing, as the teachings of the invention will suggest modifications to persons skilled in the art.

I claim:

1. In an engine cooling system that includes a fan for cooling the engine coolant:

means for driving the fan at variable speed, comprising a hydrostatic transmission that includes a variable displacement pump (10) driven by the engine to produce a hydraulic output 13, a fixed displacement fan motor (12) receiving the pump output (13), and a hydraulic return line (at 19,21) interconnecting the motor and pump; control means for the aforementioned driving means, comprising first thermostatic means (17) responsive to engine temperature for developing a first positive control signal (at 39), a flow-responsive element (23) arranged in the aforementioned hydraulic return line for developing a second negative control signal (at 40), comparator means (37) receiving the first and second signals, said comparator means producing an output signal (at 36) representing the differential between the first and second signals, and means for applying said output signal to the aforementioned pump (10) to vary its displacement, whereby said motor (12) drives the fan at varying speeds sufficient to maintain a substantially uniform engine temperature under a range of operating conditions;

a second engine-driven make-up pump (41) having a relatively small output that is directly related to engine speed, and conduit means (43) directing the pump (41) output to the aforementioned return line at a point upstream from the aforementioned flow-responsive element (23), whereby said element (23) produces a signal that is related both to fan motor speed and engine speed.

2. The system of claim 1: said comparator means comprising a balancing arm structure (37) located to receive the first control signal at one of its ends and the second control signal at its other end; the balancing arm structure producing the aforementioned output signal at a point intermediate its ends.

3. The system of claim 1: and further comprising force-multiplication means (at 30,26) for increasing the magnitude of the output signal before application thereof to the pump (10).

4. The system of claim 3: said force-multiplication means comprising a flow-apportioning valve (30) mechanically connected to the balancing arm structure, and a hydraulic piston (26) connected to the aforementioned pump (10); said apportioning valve being hydraulically connected to the aforementioned return line to selectively direct pressure liquid against opposite faces of the hydraulic piston in accordance with small mechanical forces applied to the valve by the arm structure.

* * * * *